US010183310B1

(12) United States Patent
Kern

(10) Patent No.: US 10,183,310 B1
(45) Date of Patent: Jan. 22, 2019

(54) ROLLER SYSTEM

(71) Applicant: John M Kern, Helena, OH (US)

(72) Inventor: John M Kern, Helena, OH (US)

( * ) Notice: Subject to any disclaimer, the term of this patent is extended or adjusted under 35 U.S.C. 154(b) by 282 days.

(21) Appl. No.: 15/095,411

(22) Filed: Apr. 11, 2016

Related U.S. Application Data

(63) Continuation-in-part of application No. 14/166,216, filed on Jan. 28, 2014, now Pat. No. 9,308,549, which is a continuation-in-part of application No. 61/757,858, filed on Jan. 29, 2013.

(51) Int. Cl.
*B05C 17/02* (2006.01)
*B25G 3/08* (2006.01)
*B25G 1/10* (2006.01)

(52) U.S. Cl.
CPC ..... *B05C 17/0205* (2013.01); *B25G 1/102* (2013.01); *B25G 3/08* (2013.01)

(58) Field of Classification Search
CPC ..... B05C 17/0205; B25G 3/08
See application file for complete search history.

(56) References Cited

U.S. PATENT DOCUMENTS 6,742,213 B1 * 6/2004 Vaes ..... A46B 3/12 15/143.1
8,595,883 B1 * 12/2013 Kern ..... A46B 5/0095 15/143.1
9,308,549 B1 * 4/2016 Kern ..... B05C 17/0222
2005/0229361 A1 * 10/2005 Nicolay ..... A45F 5/00 16/436

* cited by examiner

*Primary Examiner* — Randall Chin
(74) *Attorney, Agent, or Firm* — Jerry Semer

(57) ABSTRACT

The articles of manufacture a roller with an offset handle that is part of paint brush and roller system. The roller has an offset handle in which the painter grips above the plane of the roller. The handle is removable from the roller and can be used with different sizes of brush heads. The handle is designed such that the ordination of the roller's painting surface can be changed.

9 Claims, 11 Drawing Sheets

ROLLER SYSTEM

FIELD OF INVENTION

This invention relates to the field of devices for paint application by rollers and more particularly to the field of roller handles that are offset above the plane of the roller.

BACKGROUND OF THE INVENTION

Applicant has developed a whole new painting system. The painting system centers around two different handles which were patented in U.S. Pat. No. 8,595,883 B1 issued Dec. 3, 2013 which the applicant incorporate by reference into this application. Applicant is expanding his system and extending the use of his handle to a roller. Thus, painter can place either the brush head or a roller on the handle. The offset handle enables the painter to use the roller with a different motion then the roller presently out on the market. It has been applicant's experience that painters who use the roller with the offset handle preferred it to a regular roller with a regular handle. The handle on the new roller is offset and allows the painters hand that grips the roller above the plane of the roller. This enables the painter to have more control over the roller. The painters grip on the roller is also more relaxed and natural.

U.S. Pat. No. 6,742,213 to Vaes shows a paintbrush with an offset handle. Vaes paintbrush is very different form the offset roller's handle of this application. In Vaes the offset of the handle of the paintbrush is beneath the plane of the paintbrush and thus the individual can view over the top of his hand as shown in FIG. 5 of Vaes. FIG. 5 of Vaes shows the line of sight of the individual over the hand and over the paintbrush. Vaes design his paint brush for individuals to have a better line of sight over their paintbrush when painting overhead. In FIG. 5 the offset of the handle of the paintbrush is beneath the plane of the paintbrush and thus the individual can view over the top of his hand. The applicant's paint roller is not designed to view over the hand. The applicants paint roller an individual grasps the handle located above the plane of the roller. The handle is offset above the roller. Thus, the individual cannot site over the hand. The handle on the new roller is offset and allows the painters hand that grips the roller above the plane of the roller. This enables the painter to have more control over the roller. The painters grip on the roller is also more relaxed and natural. It has been applicant's experience that painters who use the roller with the offset handle preferred it to a regular roller with a handle.

SUMMARY OF THE INVENTION

The article of manufacture is a new type of roller with an offset handle that places the painter's hand that grips the roller above the plane of the roller. This roller is an extension of the new painting system that Applicant has developed and patented in U.S. Pat. No. 8,595,883 B1 issued Dec. 3, 2013 which the applicant incorporates by reference into this application.

The roller is similar to the rollers presently on the market. However, the handle has been removed and replaced with a dovetail. This dove tail fits within the dovetail groove on the offset handle. At the very bottom of the dovetail is a threaded extension. The threaded extension is designed to allow a pole with threads on its top to be threaded within the threaded extension to extend the handle of the roller for painting in high areas and ceilings.

DETAILED DESCRIPTION OF THE PREFERRED EMBODIMENT

Figure 1:
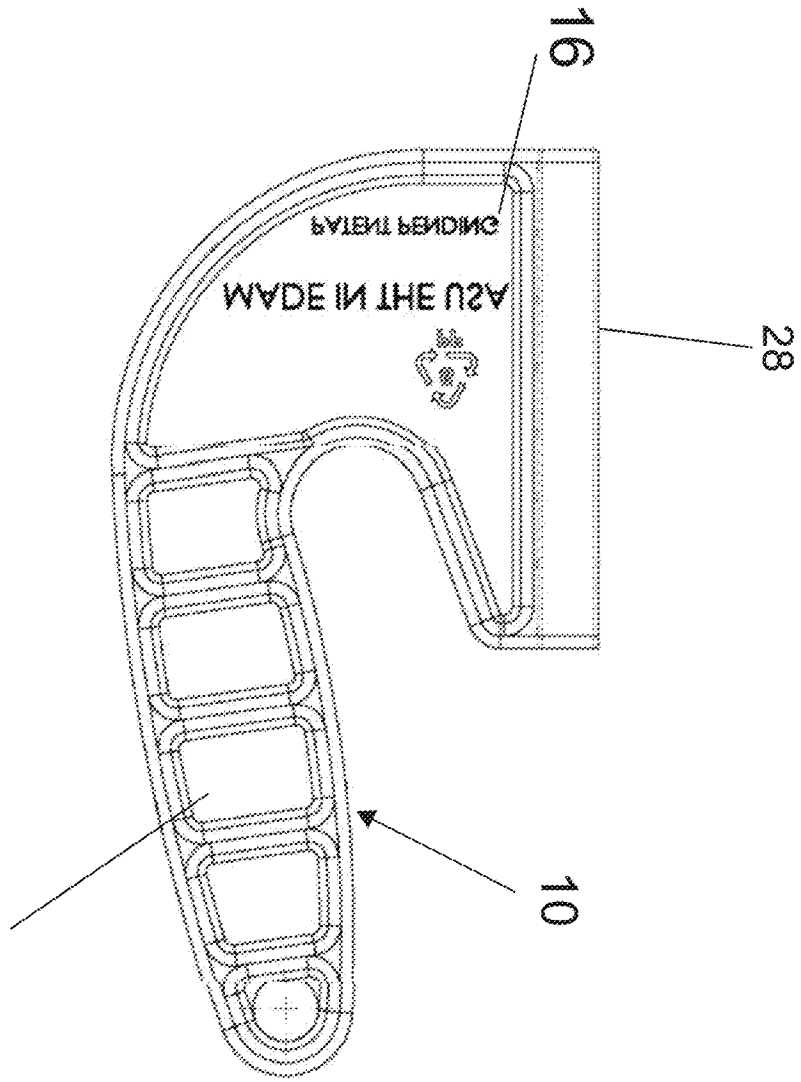
FIG. 1 is a front view of the offset handle.
Figure 2:
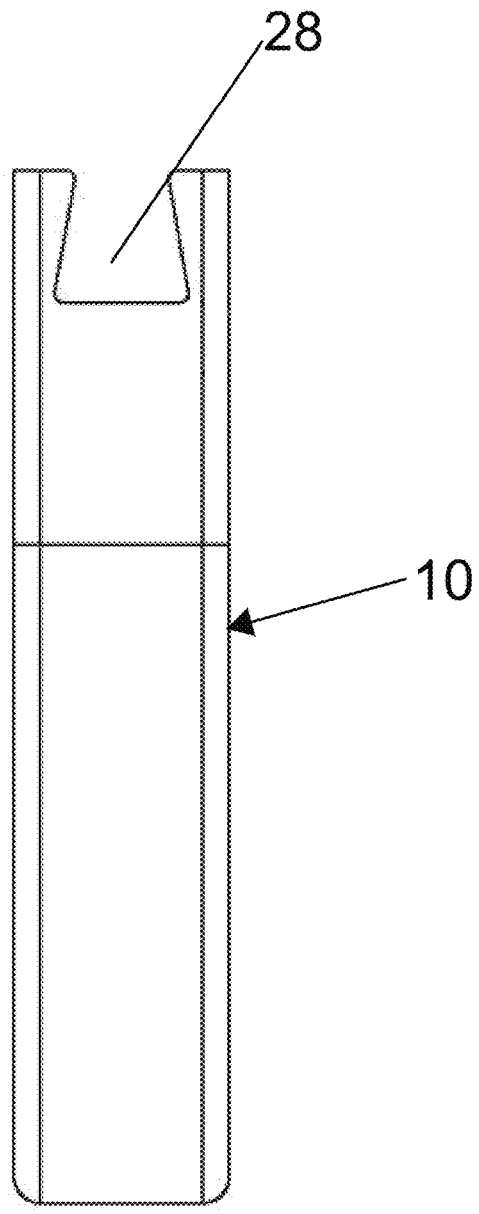
FIG. 2 is the side view of the offset handle.

FIG. 1 is a front view of the offset handle 10. FIG. 2 shows the side view of the offset handle 10. At the top of the offset handle 10 is a dovetail groove 28. The dovetail groove 28 runs along the length of the top of the offset handle 10. The offset handle 10 extends downward from the dovetail groove 28. The offset handle 10 extends downward from the side of a dovetail groove section 16 for a short distance. Than the bottom section 12 of the offset handle 10 extends nearly parallel to the dovetail groove 28. The bottom section 12 leaves an open area between it and the dove tail grove section 16. The bottom section 12 extends past the end of the dovetail grove 28 and nearly parallel to the dovetail grove 28.

To grip the offset handle 10 one places his fingers between the bottom section 12 of the offset handle 10 and the dovetail groove section 16 and then wraps one's fingers around the bottom section 12 of the offset handle 10. The bottom section 12 of the offset handle 10 is larger than a normal paintbrush handle. This enables the individual using the offset handle 10 to grip the offset handle 10 more easily.

FIG. 2 is the side view of the offset handle 10. FIG. 2 shows the shape of the dove tail groove 28. The dovetail groove 28 is a dovetail with its sides slanting outward.

Figure 3:
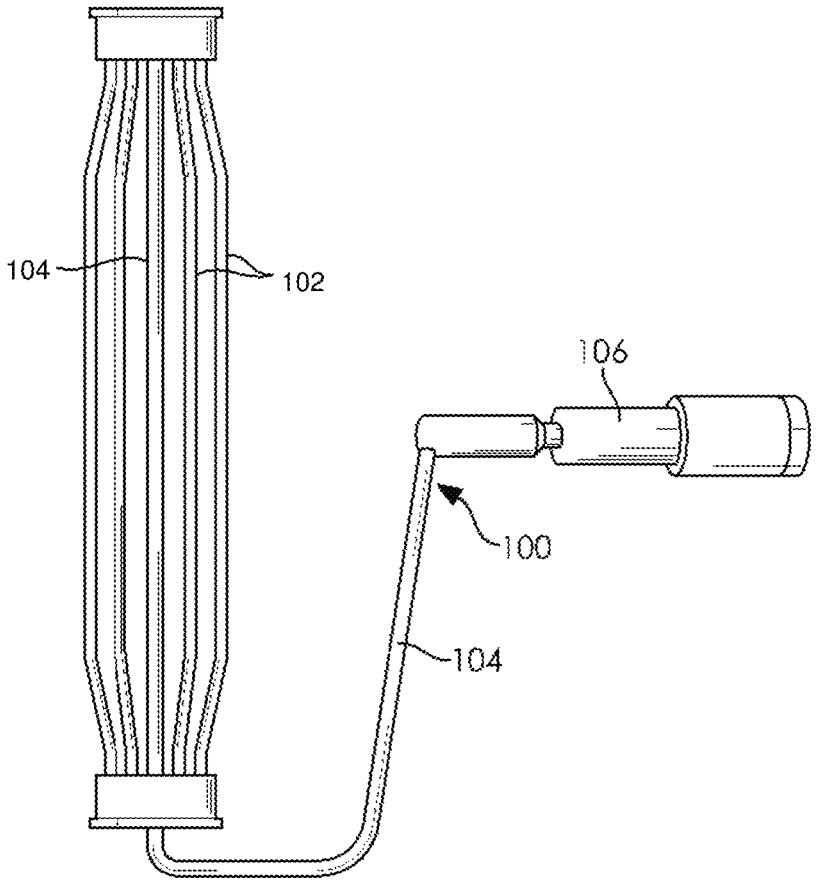
FIG. 3 is a front view of the attachment roller.

FIG. 3 shows an attachment roller 100 for offset handle 10. The attachment roller 100 looks similar to a roller that is presently on the market. As the roller presently on the market the attachment roller 100 has at its top a cage 102 on which the roller's 100 painting surface is placed. The cage 102 is designed to rotate around a cylindrical bar 104. The cylindrical bar 104 passes through the center of the cage 102 and upon exiting the cage bends downward. The cylindrical bar 104 then bends back towards the handle attachment 106 or 206. In rollers presently on the market the cylindrical bar would then bend back towards a straight handle. In the present invention the cylindrical bar 102 bends back towards the handle attachment 106 or 206. In other words applicants invention differs from the roller presently on the market in that the handle of the roller presently a on the market has been replaced by the handle attachment 106 or 206.

Figure 4:
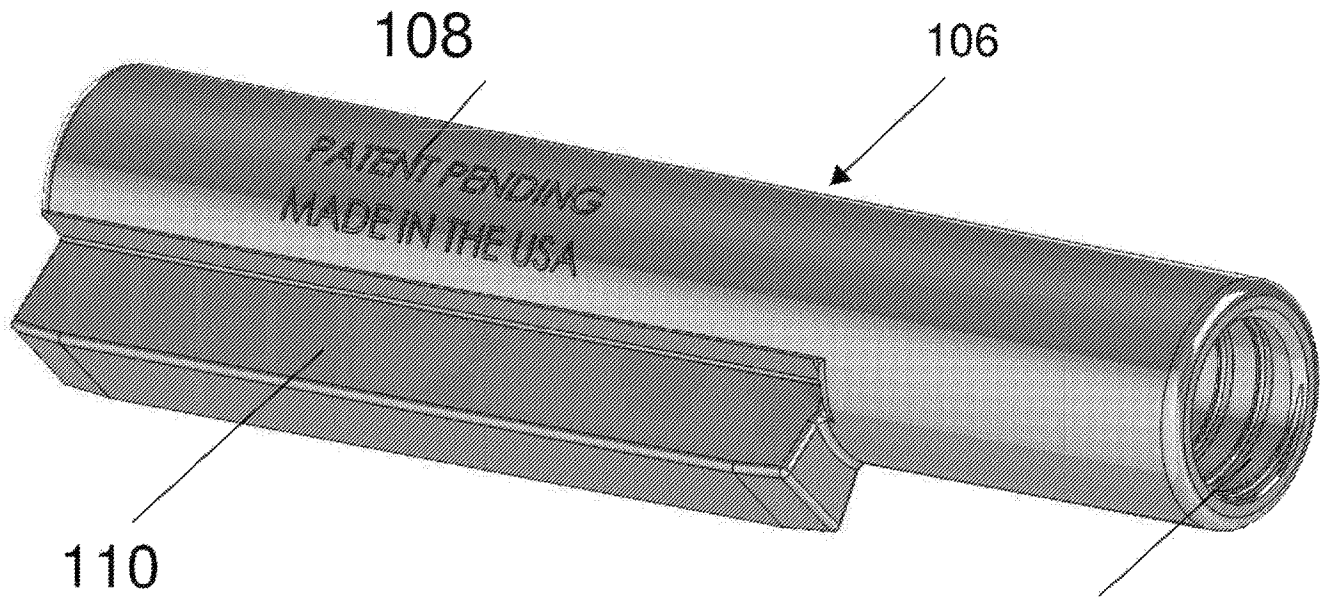
FIG. 4 is a side view of the handle attachment.

The handle attachment 106 is shown in FIG. 4. The handle attachment 106 is comprised of the attachment block 108 that attaches the handle attachment 106 to the cylindrical bar 104 and a dove tail extension 110. Extending from the side of the handle attachment block 108 is the dovetail extension 110. To use the attachment roller 100 the dovetail extension 110 of the handle attachment 106 is placed within the dove tail groove 28 of the offset handle 10.

At the bottom of the handle attachment 106 a threaded extension 112 is attached. This threaded extension 112 is threaded and is designed to allow a pole to be threaded within. When the pole is threaded within the threaded extension 112 the roller 100 can be used to paint ceilings and high areas.

Figure 5:
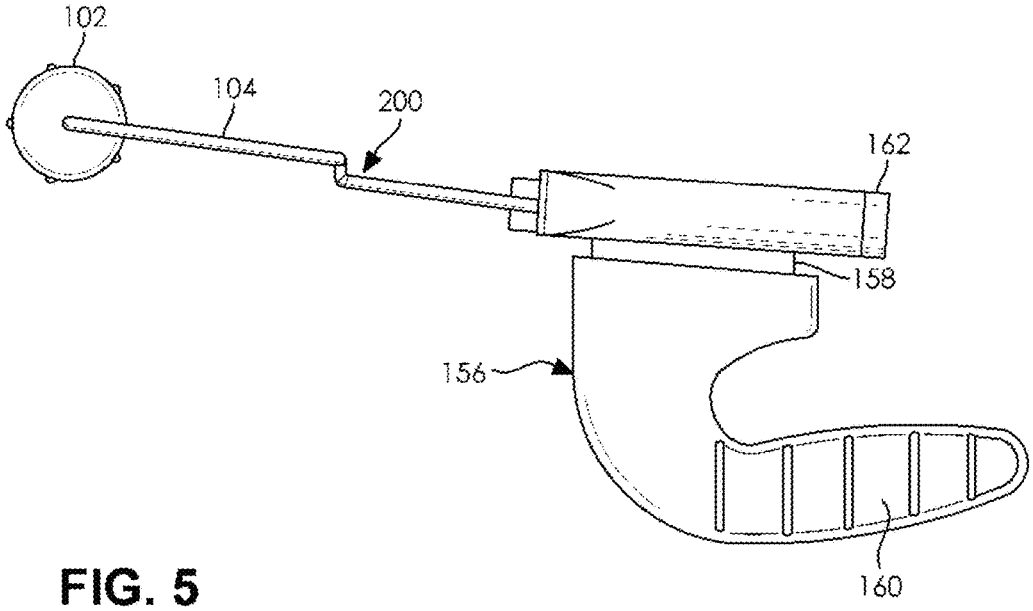
FIG. 5 is a view of the roller.

FIG. 5 shows another embodiment of the invention. FIG. 5 looks exactly as FIG. 3 with the offset handle 10 attached except the handle in FIG. 5 is not detachable. In FIG. 5 the roller 200 is exactly the same as the roller 100 in FIG. 3. As in the previous embodiment the roller 200 has at its top a cage 102 on which the roller's 200 paint surface is placed. The cage 102 is designed to rotate around a cylindrical bar 104. The cylindrical bar 104 passes through the center of the cage 102 and upon exiting the cage turns downward. The cylindrical bar 104 then bends back towards the offset roller handle 156. Unlike the previous embodiment the cylindrical bar 104 does not attach to the handle attachment 106, it attaches directly to the offset roller handle 156. Offset roller handle 156 is almost exactly like offset handle 10. The only difference is that the cylindrical bar 104 attaches permanently to offset roller handle 156 on the side of offset handle 156. In offset roller handle 156 the dovetail groove section 16 of offset handle 10 has been replaced by the attaching cylindrical bar section 158. On the side of offset roller handle 156 in place of the dovetail groove 28 of offset handle 10 is the attaching bar section 158. The offset roller handle 156 extends away from the attaching bar section 158. The offset roller handle 156 extends away from the attaching bar section 158 for a short distance. Then the offset roller handle's 156 bottom section 160 extends parallel to the attaching bar section 158. To use the roller one grips the bottom section 160 of the offset roller handle 156 by placing one's fingers between the bottom section 160 of the offset handle 156 and the attaching bar section 158. This enables the painters hand to grips the offset handle 156 above the plane of the roller. This allows the individual using the offset roller handle 156 to grip the offset roller handle 156 more easily.

Attaching to the bottom of the attaching cylindrical bar section 158 is a threaded extension 162. This threaded extension 162 is threaded and is designed to allow a pole to be threaded within. When the pole is threaded within the threaded extension 162 the roller 200 can be used to paint ceilings and high areas.

Figure 6:
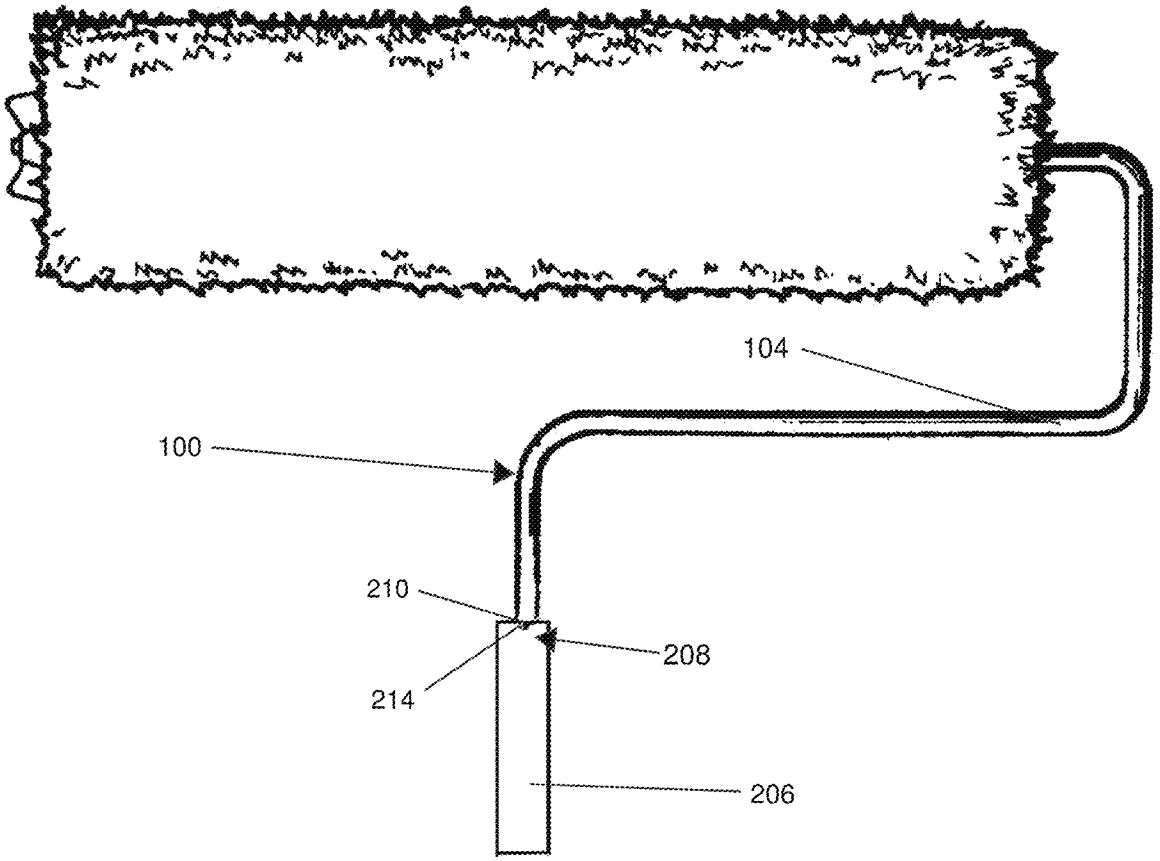
FIG. 6 is a front view of another embodiment of the attachment roller with the cylindrical bar extending from the roller paint surface from the right
Figure 7:
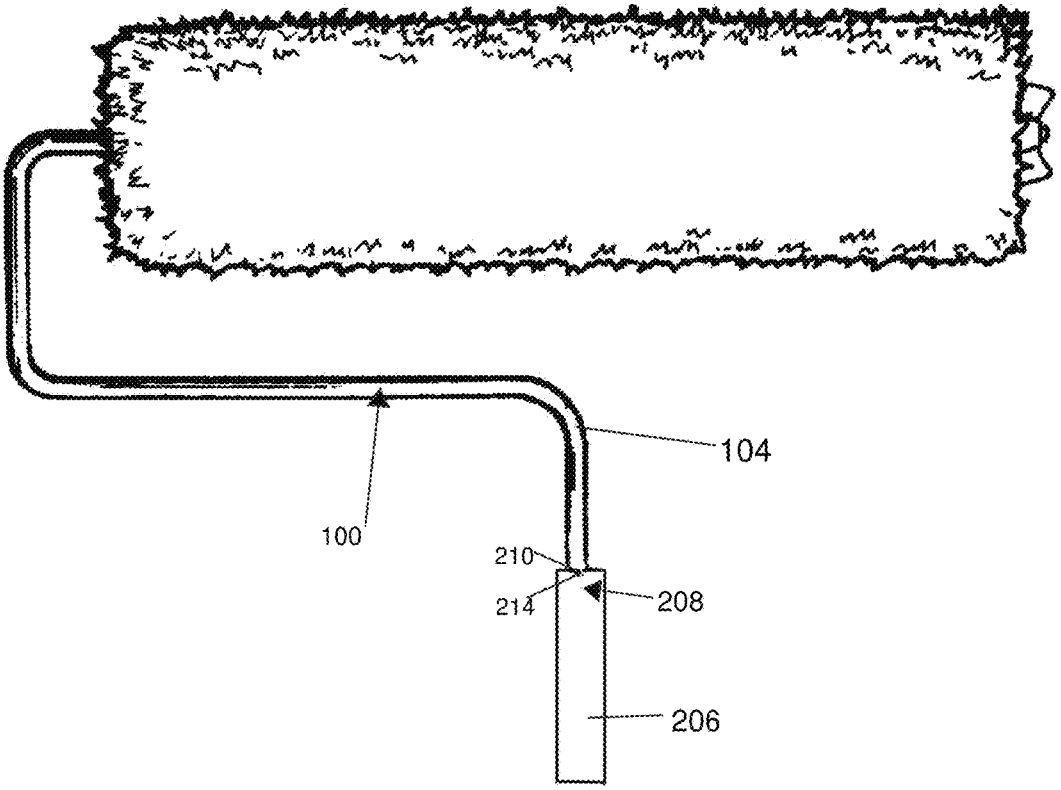
FIG. 7 is a front view of the attachment roller of FIG. 6 with the cylindrical bar extending from the roller paint surface from the left.
Figure 10:
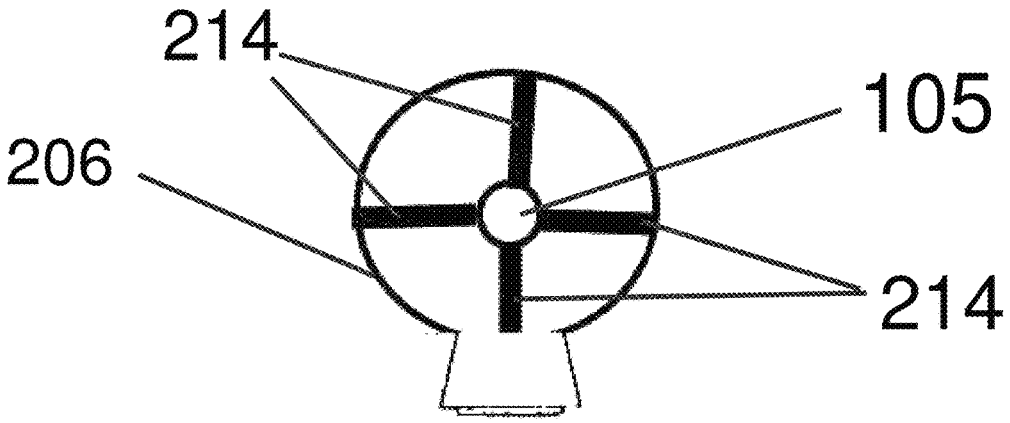
FIG. 10 is the top view of the handle attachment.

FIGS. 6 and 7 show the attachment roller 100 with handle attachment 206 replacing handle attachment 106. The top section of handle attachment 206 is shown in FIG. 10. Handle attachment 206 is exactly the same as attachment 106 except for is top. The top of handle attachment 206 contains a means for shifting the position of the roller 208 as shown FIG. 10. In FIG. 6 the cylindrical bar 104 comes out of the roller's 100 paint surface form the right and in FIG. 7 the cylindrical bar 104 comes out of the roller's 100 paint surface from the left. This is accomplished by a means for shifting the position 208 of the roller 100 in the top of the handle attachment 206. The means of shifting the position 208 of the roller 100 is comprised of a pin 210 that extends from each side of the cylindrical bar 104. Cylindrical bar 104 is placed in an opening 105 in the top of handle attachment 206. The cylindrical bar 104 in inserted into opening 105 far enough that pin 210 fits on top of handle attachment 206. On top of handle attachment 206 are slots 214. The pin 210 is pressed into slots 214 where pin 210 locks into place. This orients the roller 100 in one locked position. To lock the roller 100 in the another locked position one lifts pin 210 out of slot 214 and twist the roller 100 to orient it in the another position, than one press the pin 210 into slots 214 where pin 210 is locked into place. There can be several slots 214 on the top of the handle attachment 206 to enable the roller 100 to be locked into several positions.

Figure 8:
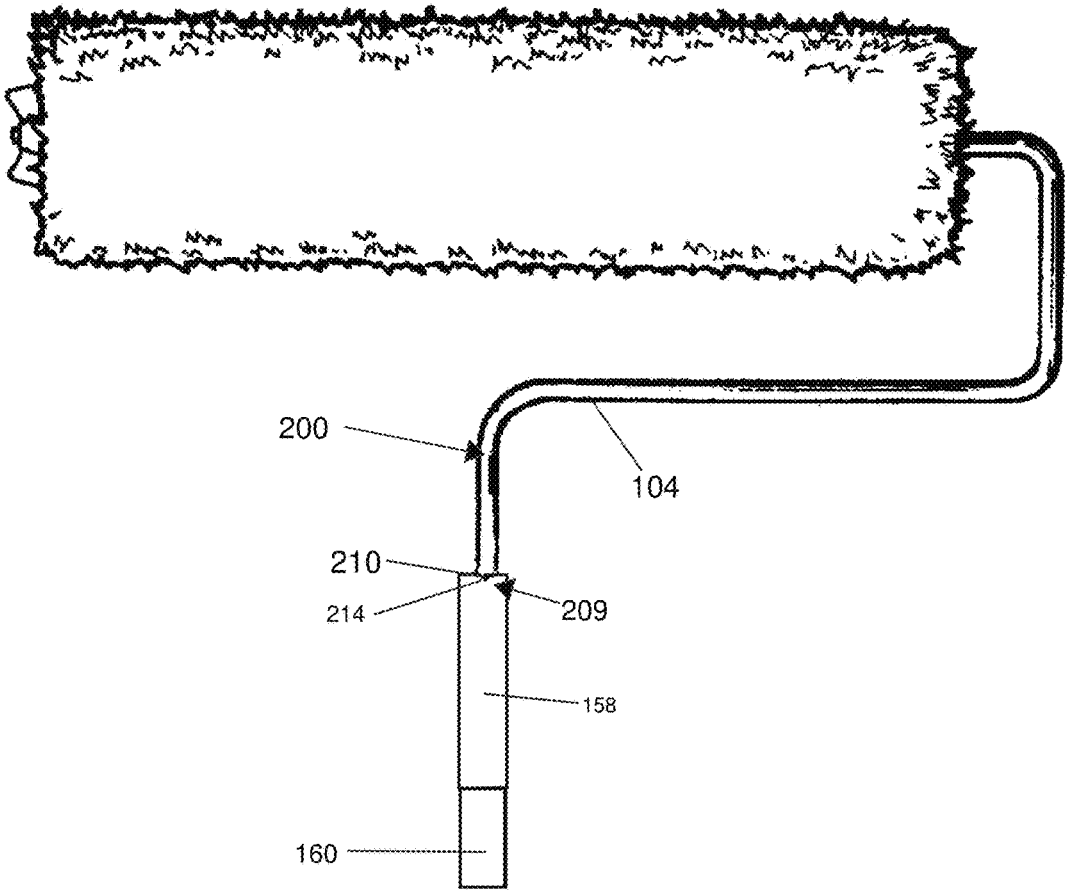
FIG. 8 is a front view of another embodiment of the roller with the cylindrical bar extending from the roller paint surface from the right.
Figure 9:
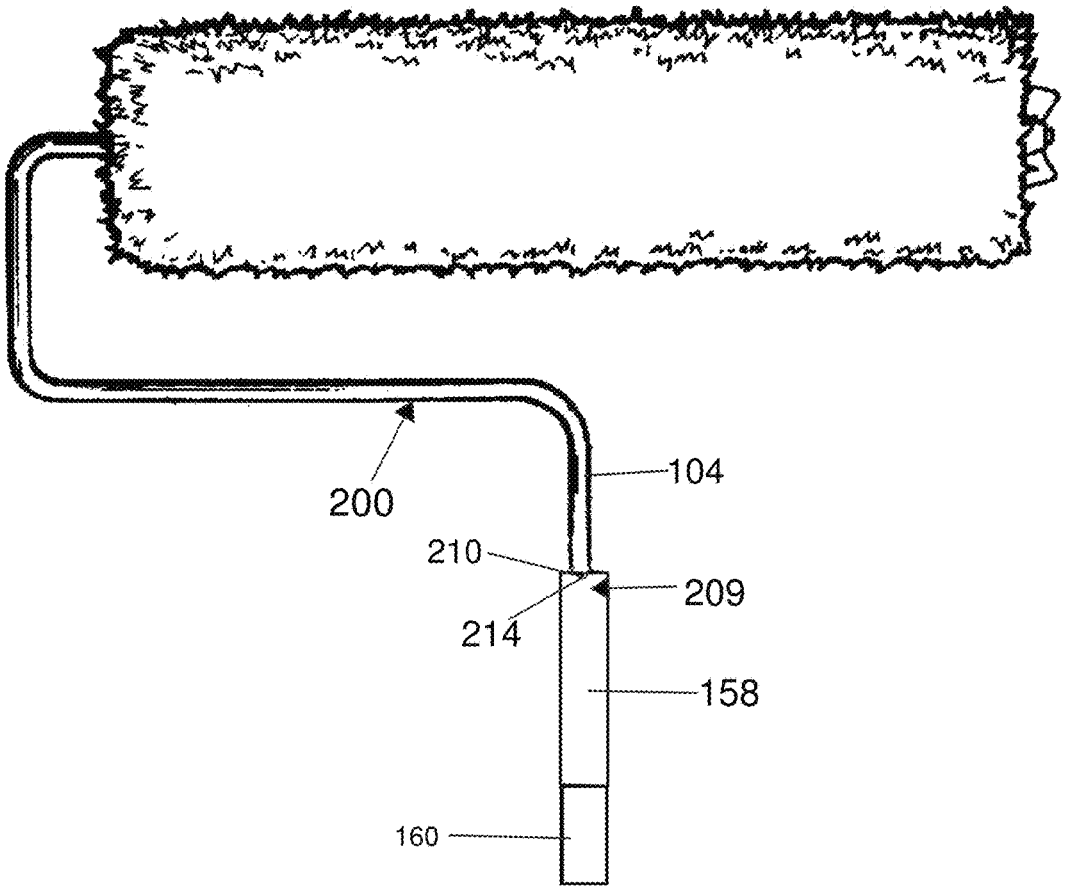
FIG. 9 is a front view of the roller of FIG. 8 with the cylindrical bar extending from the roller paint surface from the left.
Figure 11:
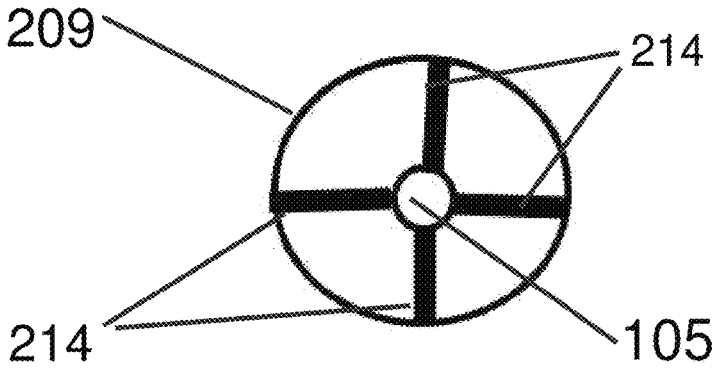
FIG. 11 is the top view of the attaching cylindrical bar section.

FIGS. 8 and 9 show another embodiment of the invention. This embodiment is almost the same as FIG. 5 except that the top of attaching cylindrical bar section 158 contains a means for shifting the position of the roller 209 as shown in FIG. 11. In FIG. 8 the cylindrical bar 104 comes out of the roller's 200 paint surface form the right and in FIG. 9 the cylindrical bar 104 comes out of the roller's 200 paint surface from the left. This is accomplished by a means for shifting the position 209 of the roller 200 in the top attaching cylindrical bar section 158. The means of shifting the position 209 of the roller 200 is comprised of a pin 210 that extends from each side of the cylindrical bar 104. Cylindrical bar 104 is placed in an opening 105 in the top of attaching cylindrical bar section 158. The cylindrical bar 104 in inserted into opening 105 far enough that pin 210 fits on top of attaching cylindrical bar section 158. On top attaching cylindrical bar section 158 are slots 214. The pin 210 is pressed into slots 214 where pin 210 locks into place. This orients the roller 200 in one locked position. To lock the roller 200 in the other lock position one lifts pin 210 out of slot 214 and twist the roller 200 to orient it in the another position, than one press the pin 210 into slots 214 where pin 210 is locked into place. There can be several slots 214 on the top of attaching cylindrical bar section 158 to enable the roller 100 to be locked into several positions.

Applicant has found that painters prefer his offset roller handle to the rollers that are now out on the market. Many have told him that it places the roller in an easier position to paint a wall.

I claim:

1. A paint roller attachment comprising:

a. a cylindrical cage on which a cylindrical painting surface is placed; and, b. a cylindrical bar axle that is axially attached to the cylindrical cage and passing through the center of the cylindrical cage; and, c. the cylindrical bar axle upon exiting the cage bends downward; and, d. the cylindrical bar axle then bends back parallel to the cylindrical cage; and e. an attaching section with two ends, an attaching end, and a distal end, and the attaching end attaches at one end to the cylindrical bar axle at a right angle and extends perpendicularly from the cage and is oriented substantially along a center line with the cage and form a plane with the cage; and, f. a handle attached to the attaching section comprising:

1) a handle attaching section that attaches to the attaching section, and 2) a grasping section that is attached to the handle attaching section and that is offset, above, and parallel to the plane when being grasped leaving an open area for the fingers between the grasping section and the plane such that the grasping section can be grasped and said grasping section is perpendicular to the cage.

2. A paint roller attachment as in claim 1 wherein:

a. the handle is permanently attached to the attaching section.

3. A paint roller attachment as in claim 1 wherein:

a. the handle is designed to be removed and reattached attached to the attaching section.

4. A paint roller attachment as in claim 1 further comprising:

a. a threaded extension attached to the distal end of the attaching section; and, b. said threaded extension is a cylindrical tube with threads on an inner wall; and, c. the threaded extension allows a pole with a threaded end to be screwed to the attaching section.

5. A paint roller attachment as in claim 1 further comprising:

a. a means for shifting the orientation of the cage.

6. A paint roller attachment as in claim 5 further comprising:

a. the means for shifting the orientation of the cage comprises 1) a pin that extends from each side of the cylindrical bar axle; and, 2) a first slot on the top of the attaching section; and, 3) a second slot on the top of the attaching section; and, 4) wherein the pin is pressed into the first slot where the pin locks into place and this orients the cage in one position and to change that position the pin is lifted out of the first slot and the cage is twisted and pressed in the second slot to orient the cage in another position.

7. A paint roller attachment comprising:

a. a cylindrical cage on which a cylindrical painting surface is placed; and, b. a cylindrical bar axle that is axially attached to the cylindrical cage and passing through the center of the cylindrical cage; and, c. the cylindrical bar axle upon exiting the cage bends downward; and, d. the cylindrical bar axle then bends back parallel to the cylindrical cage; and e. an attaching section with two ends, an attaching end and a distal end, and the attaching end attaches at one end to the cylindrical bar axle at a right angle and is located below the cylindrical cage and extends perpendicularly from the cage and in position on a center line with the cage, f. the attaching section is comprised of;

(1). an elongated block with the attaching end and a distal end and the attaching end attaches to the cylindrical bar axle; and, (2). a dove tail extension that extends from a side of the elongated block with the distal end; and, g. a means for shifting the orientation of the cage.

8. A paint roller attachment as in claim 7 further comprising:

a. a threaded extension attached to the distal end of the attaching section; and, b. said threaded extension is a cylindrical tube with threads on an inner wall; and, c. the threaded extension allows a pole with a threaded end to be screwed to the attaching section.

9. A paint roller attachment as in claim 7 further comprising:

a. the means for shifting the orientation of the cage comprises;

1) a pin that extends from each side of the cylindrical bar axle; and, 2) a first slot on the top of the attaching section; and, 3) a second slot on the top of the attaching section; and, 4) wherein the pin is pressed into the first slot where the pin locks into place and this orients the cage in one position and to change that position the pin is lifted out of the first slot and the cage is twisted and pressed in the second slot to orient the cage in another position.

* * * * *